US010057685B2

(12) United States Patent
Mao et al.

(10) Patent No.: US 10,057,685 B2
(45) **Date of Patent: *Aug. 21, 2018**

(54) SPEAKER

(71) Applicant: AAC Technologies Pte. Ltd., Singapore (SG)

(72) Inventors: Lubin Mao, Shenzhen (CN); Shun Guo, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 15/417,159

(22) Filed: Jan. 26, 2017

(65) Prior Publication Data

US 2017/0347199 A1 Nov. 30, 2017

(30) Foreign Application Priority Data

May 26, 2016 (CN) ..... 2016 2 0490425 U

(51) Int. Cl.

| | |
|---|---|
| ***H04R 1/00*** | (2006.01) |
| ***H04R 9/02*** | (2006.01) |
| ***H04R 9/06*** | (2006.01) |
| ***H04R 31/00*** | (2006.01) |

(52) U.S. Cl.

CPC ..... *H04R 9/025* (2013.01); *H04R 9/06* (2013.01); *H04R 31/006* (2013.01); *H04R 2400/03* (2013.01); *H04R 2400/07* (2013.01)

(58) Field of Classification Search

CPC combination set(s) only.
See application file for complete search history.

(56) References Cited

U.S. PATENT DOCUMENTS

2004/0240702 A1* 12/2004 Kaiwa ..... H04R 1/06 381/423

* cited by examiner

*Primary Examiner* — Amir Etesam
(74) *Attorney, Agent, or Firm* — Na Xu; IPro, PLLC

(57) ABSTRACT

The present disclosure provides a speaker, including a vibrating system and a magnetic circuit system driving the vibrating system to vibrate and sound, the magnetic circuit system includes a main magnet assembly, the main magnet assembly includes a first main magnet, a magnetic conductive piece and a second magnet which are arranged by stacking, poles of the first main magnet and the second main magnet having a same polarity are opposite to each other, the magnetic conductive piece includes a body portion clamped between the first main magnet and the second main magnet, and a clamping portion bending and extending from the body portion, the clamping portion includes a first clamping portion for fixing the first main magnet and a second clamping portion for fixing the second main magnet. The speaker provided by the present disclosure improves acoustic performance through providing the clamping portion on the magnetic conductive piece.

9 Claims, 5 Drawing Sheets

SPEAKER

TECHNICAL FIELD

The present disclosure relates to the field of electro-acoustic conversion technologies and, in particular, to a speaker.

BACKGROUND

In recent years, with the booming development of information technology, the audio devices are widely applied. The requirements on audio devices do not only concern video and audio play, but also concern reliability of the audio devices. In particular, together with the 3G generation, mobile multi-media technology is developing fast, many audio devices have entertaining functions such as video play, digital camera, games, GPS navigation etc., all of which require more precise and compact electronic components to be used in the audio devices.

In an audio device, the speaker is a common electronic component, which is mainly used for audio signal playing, the design structure directly affect the quality of audio play. The speaker in the related art generally includes a magnetic circuit system, a vibrating system and a housing, the magnetic circuit system includes a pair of magnets of which the ends with same polarity are opposite to each other, and a soft magnet clamped between the magnets, the magnet is assembled with the soft magnet through gluing.

However, the two magnets in the magnetic circuit system in the related art are magnets of which the ends with the same polarity are opposite to each other, exclusive force exists therebetween, thus the fixing effect is poor due to gluing assembling, which significantly affect the reliability of the magnetic circuit system, thereby affecting acoustics performance of the speaker.

Therefore, there is a necessity to provide a new speaker so as to solve the above problem.

BRIEF DESCRIPTION OF DRAWINGS

Many aspects of the exemplary embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and following embodiments.

Figure 1:
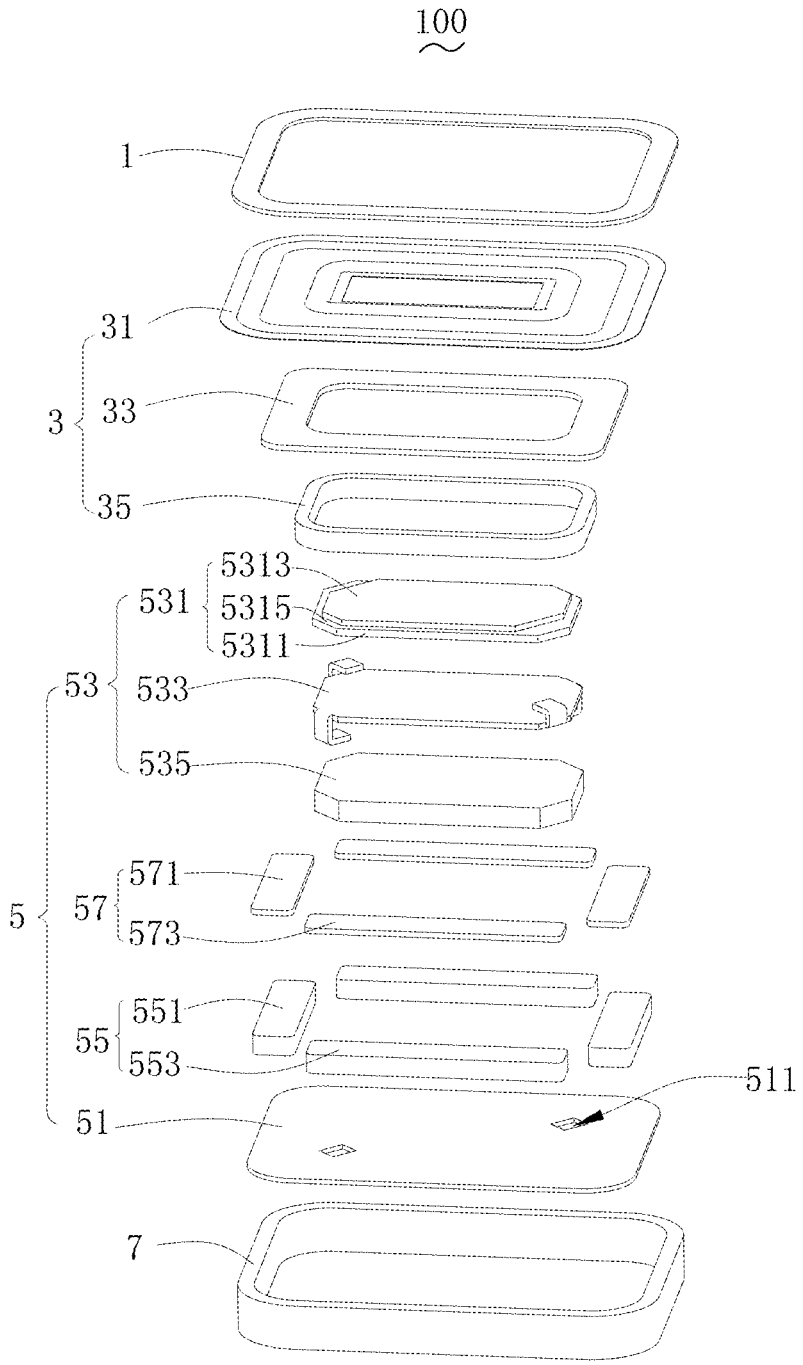
FIG. 1 is a perspective exploded schematic view of a speaker in accordance with an exemplary embodiment of the present disclosure.
Figure 2:
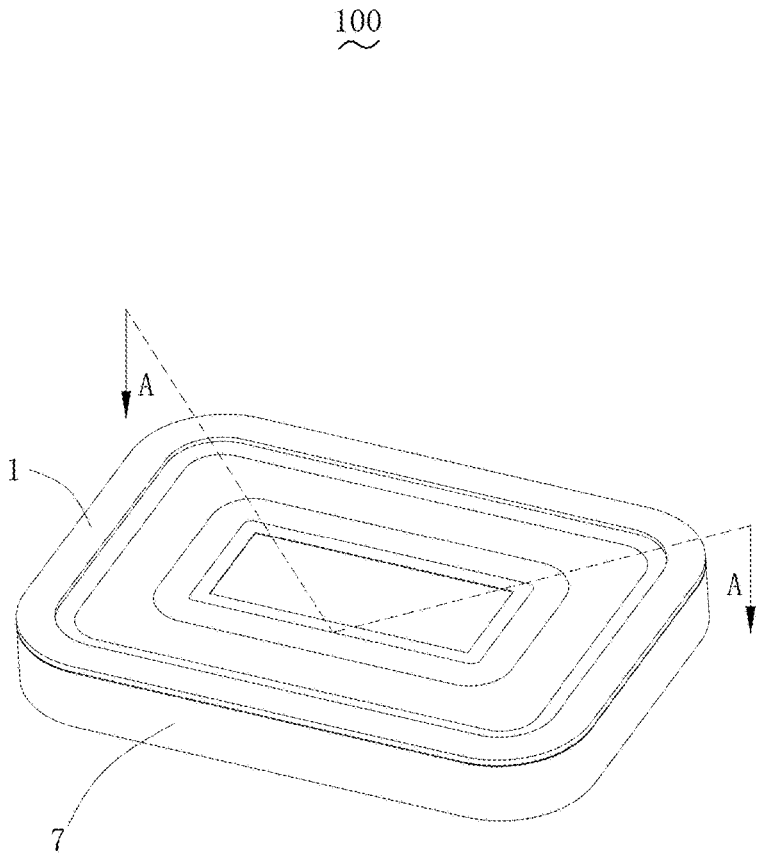
FIG. 2 is a perspective assembling schematic view of the speaker shown in FIG. 1.
Figure 3:
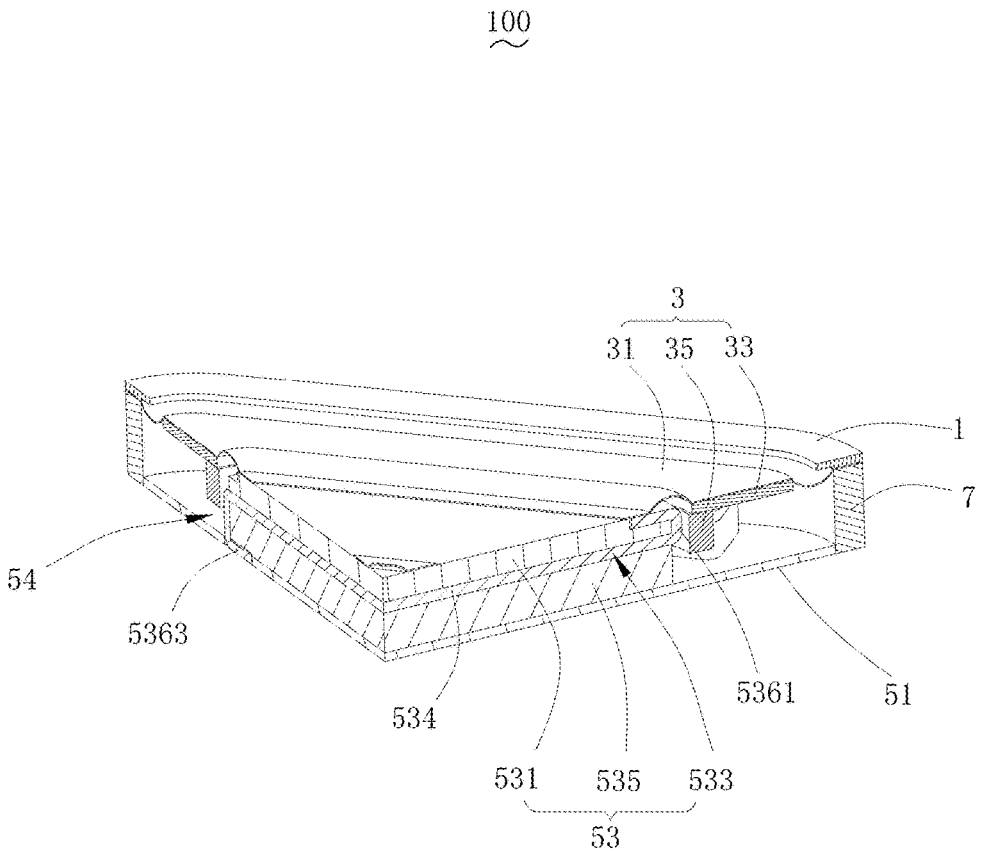
FIG. 3 is a sectional view of the speaker shown in FIG. 2 along A-A line.

Please refer to FIG. 1, FIG. 2 and FIG. 3, FIG. 1 is a perspective exploded schematic view of a speaker in accordance with an exemplary embodiment of the present disclosure; FIG. 2 is a perspective assembling schematic view of the speaker shown in FIG. 1; FIG. 3 is a sectional view of the speaker shown in FIG. 2 along A-A line. The speaker 100 includes a cover plate 1, a vibrating system 3, a magnetic circuit system 5 and a frame 7 assembled with the cover plate 1. The magnetic circuit system 5 is configured to generate magnetic field, the vibrating system 3 is driven in the magnetic field to generate vibration, so as to sound. In the present embodiment, both the cover plate 1 and the frame 7 are of an annular rectangular shape.

The vibration system 3 includes a diaphragm 31, a dome 33 and a voice coil 35 driving the diaphragm 31 to vibrate and sound, which are successively stacked from top to bottom. A periphery of the diaphragm 31 is clamping between the cover plate 1 and the frame 7.

The magnetic circuit system 5 includes a magnetic yoke 51, a main magnet assembly 53, an auxiliary magnet assembly 55 and a pole plate assembly 57. The main magnet assembly 53 and the auxiliary assembly 55 are both assembled on the magnetic yoke 51, the auxiliary magnet assembly 55 surrounds the periphery of the main magnet assembly 53, they form a magnetic gap 54, the voice coil 35 is inserted into the magnetic gap 54, the pole plate assembly 57 is attached onto the auxiliary magnet assembly 55 far away from the surface of the magnetic yoke 51.

In the present embodiment, the magnetic yoke 51 is of a plate structure, and cooperates with the cover plate 1 and the frame 7 to form accommodating space for accommodating the vibrating system 3 and the magnetic circuit system 5. The magnetic yoke 51 generally does not generate magnetic field itself, the magnetic circuit system 5 is only a soft magnetic material for magnetic field transmission, which is generally manufactured adopting soft iron or soft magnetic alloy having relative high magnetic conductivity.

Figure 4:
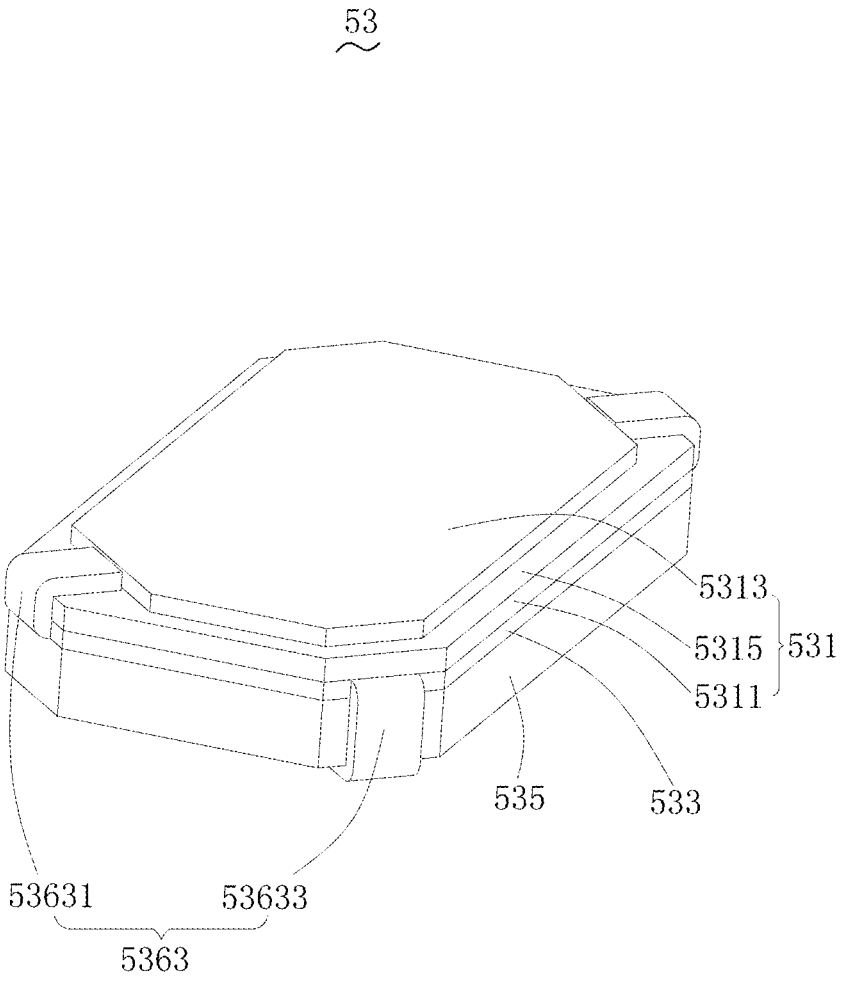
FIG. 4 is a structural schematic view of a main magnet assembly of the speaker shown in FIG. 1.

Please refer to FIG. 4, which is a structural schematic view of a main magnet of the speaker shown in FIG. 1. The main magnet assembly 53 is provided at a central region of the magnetic yoke 51, which includes a first main magnet 531, a magnetic conductive piece 533 and a second main magnet 535 which are arranged by stacking, poles of the first main magnet 531 and the second main magnet 535 having a same polarity are opposite to each other.

The first main magnet 531 and the second main magnet 535 are permanent magnets, two ends of which are a N pole and a S pole, respectively. Specifically, the N pole of the first main magnet 531 abuts the magnetic conductive piece 533, the N pole of the second main magnet 535 abuts the magnetic conductive piece 533, that is, the N pole of the first main magnet 531 is arranged opposite to the N pole of the second main magnet 535, so that poles of the first main magnet 531 and the second main magnet 535 having a same polarity are opposite to each other.

In the present embodiment, the first main magnet 531 is connected with the magnetic conductive piece 533 through gluing, the second main magnet 535 is connected with the magnetic conductive piece 533 through gluing, so as to further guarantee that the main magnet assembly 53 is firmly fixed. In other embodiments, other connection manners except for gluing may also be adopted between the first main magnet 531 and the magnetic conductive piece 533, and between the second main magnet 535 and the magnetic conductive piece 533.

Please refer to FIG. 1, the first main magnet 531 includes a main portion 5311, a protrusion portion 5313 extending from a surface of the main portion 5311 in a direction departing from the magnetic yoke 51, the main portion 5311 and the protrusion portion 5313 form a step 5313, the main portion 5311 has a similar with the protrusion portion 5313. In the present embodiment, the step 5315 is provided at the periphery of the main portion 5311.

Figure 5:
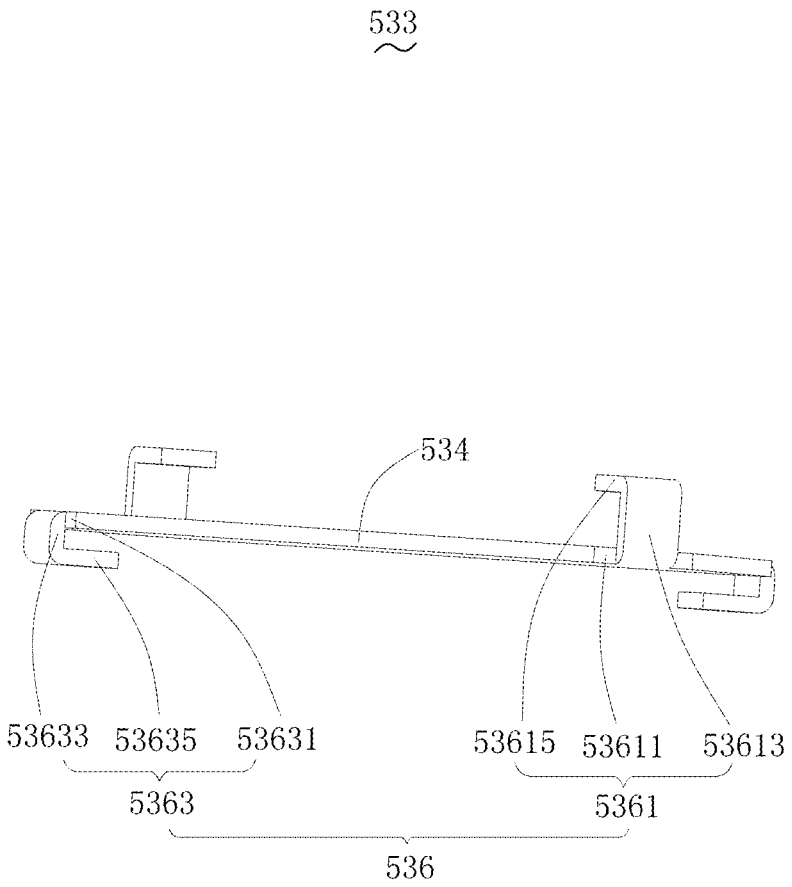
FIG. 5 is a structural schematic view of a magnetic conductive piece of the speaker shown in FIG. 1.

Please refer to FIG. 5, which is a structural schematic view of a magnetic conductive piece of the speaker shown in FIG. 1. The magnetic conductive piece 533 includes a body portion 534 clamped between a first main magnet 531 and a second main magnet 535, and a clamping portion 536 bended and extends from the body portion 534. The clamping portion 536 includes a first clamping portion 5361 for fixing the first main magnet 531 and a second clamping portion 5363 for fixing the second main magnet 535. In the present embodiment, the magnetic conductive piece 533 is a soft magnet. The clamping portion 536 is directed formed by bending and extending of the body portion 534 of the magnetic conductive piece 533, which is convenient and cost efficient.

The first clamping portion 5361 and the second clamping portion 5363 have a same structure, both of which include an avoiding portion provided at a periphery of the body portion 534, an extending portion bended and extends from the avoiding portion in a direction perpendicular to the body portion 534, and a bending portion bended and extends from the extending portion in a direction towards a central axis of the body portion 534, the bending portion is parallel to the body portion 534.

Specifically, the first clamping portion 5361 includes a first avoiding portion 53611 provided at the periphery of the body portion 534, a first extending portion 53613 bended and extends from the first avoiding portion 53611 in a direction perpendicular to the body portion 534 (i.e., in a direction towards the first main magnet 531), and a first bending portion 53615 bended and extends from the first extending portion 53613 in a direction towards a center of the body portion 534.

The first bending portion 53615 is parallel to the body portion 534, and abuts with a surface of the first main magnet 531 departing from the body portion 534, so as to fix the first main magnet 531. Specifically, the first bending portion 53615 is held at the step 5315 of the first main magnet 531, the step 5315 makes the position where the clamping portion 5361 is fixed to the first main magnet 531 be controllable, and reduce space loss as much as possible, so as to facilitate assembling.

There are a plurality of first clamping portions 5361, at least two clamping portions 5361 are symmetrically arranged at the body portion 534. In the present embodiment, there are two first clamping portions 5361, which are arranged at a pair of diagonal corners of the body portion 534 to be central symmetry. In other embodiments, the first clamping portion 5361 can also be provided at a side of the body portion 534 to be central symmetry or axial symmetry.

The second clamping portion 5363 includes a second avoiding portion 53631 provided at the periphery of the body portion 534, a second extending portion 53633 bended and extends from the second avoiding portion 53631 in a direction perpendicular to the body portion 534 (i.e., in a direction towards the second main magnet 535), and a second bending portion 53635 bended and extends from the second extending portion 53633 in a direction towards a central axis of the body portion 534.

The second bending portion 53635 is parallel to the body portion 534, and abuts with a surface of the second main magnet 535 departing from the body portion 534, so as to fix the second main magnet 535.

A position of the magnetic yoke 51 corresponding to the clamping portion 536 is provided with an avoiding notch 511 for accommodating the clamping portion 536. Specifically, in the present embodiment, a position of the magnetic yoke 51 corresponding to the second bending portion 53635 is provided with an avoiding notch 511 for accommodating the second bending portion 53635, so as to reduce space loss, and the fixation is firm, so that the second clamping portion 5363 does not readily move.

There are a plurality of second clamping portions 5363, at least two second clamping portions 5363 are symmetrically arranged at the body portion 534. In the present embodiment, there are two second clamping portions 5363, which are arranged at another pair of diagonal corners of the body portion 534 to be central symmetry. In other embodiments, the first clamping portion 5363 can also be provided at a side of the body portion 534 to be central symmetry or axial symmetry.

In the present embodiment, the shape and size of the main portion 5311 of the first main magnet 531, the body portion 534 of the magnetic conductive piece 533 and the second main magnet 535 are the same, the position of the first main magnet 531 corresponding to the first extending portion 53613 and the position of the of the second main magnet 535 corresponding to the second extending portion 53633 are properly cut to form an avoiding portion, so as to avoid the first extending portion 53613 and second extending portion 53633, so that the clamping portion 536 can better fix the first main magnet 531 and the second main magnet 535, which can effectively guarantee the reliability of the magnetic circuit system 5.

Please refer to FIG. 1, the auxiliary magnet assembly 55 includes a pair of first auxiliary magnet 551 and a second auxiliary magnet 553, the two first auxiliary magnets 551 are symmetrically provided at two opposite sides of the main magnet assembly 53, the two second auxiliary magnets 553 are symmetrically provided at another two opposite sides of the main magnet assembly 53.

The pole plate assembly 57 is made of magnetic conductive material, which plays a role of magnetic conduction, and which includes a pair of first auxiliary pole plates 571 and a pair of second auxiliary pole plates 573 respectively corresponding to a pair of first auxiliary magnet 551 and a pair of second auxiliary magnet 553. The shape and size of the first auxiliary pole plate 571 and the second auxiliary pole plate 573 are identical to the shape and size of the first auxiliary magnet 551 and the second auxiliary magnet 553.

The first clamping portion 5361 and the second clamping portion 5363 are symmetrically provided at a pair of diagonal corners of the body portion 534, respectively, which can lock the first main magnet 531 and the second main magnet 535 in the horizontal direction; the structure of the first clamping portion 5361 for fixing the first main magnet 531, and the structure of the second clamping portion 5363 for fixing the second main magnet 535 can lock the first main magnet 531, the second main magnet 535 and the magnetic conductive piece 533 at the same time, and fix the main magnet assembly 53 in vertical direction, the clamping portion 536 can lock the exclusive first main magnet 531 and second main magnet 535 in horizontal direction and in vertical direction at the same time, the fixing is more firm, and the clamping portion 536 can be designed with a proper size according to the structure and shape of the main magnet assembly 53, which is more flexible.

Comparing with the related art, the speaker 100 of provided by the present disclosure has the following beneficial effects:

I. In the magnetic circuit system 5 provided by the present disclosure, through adding the clamping portion 536 on the magnetic conductive piece 533 for fixing the first main magnet 531 and the second magnet 535, which can prevent movement due to the exclusive force between the first main magnet 531 and the second magnet 535, the fixation can be achieved in horizontal direction and vertical direction at the same time, thereby guarantee reliability of the magnetic circuit system 5, so as to guarantee acoustics performance of the speaker 100.

II. The clamping portion 536 provided by the present disclosure is directed formed by bending and extending of the body portion 534, which is convenient and cost efficient.

III. The first main magnet 531, the second main magnet 535 are respectively provided with an avoiding portion for avoidance, so that the fitting is more convenient, which is helpful for the clamping portion 536 to fix the first main magnet 531 and the second main magnet 535.

IV. The magnetic yoke 51 is provided with an avoiding notch 511 for accommodating the clamping portion 536, so as to reduce the space loss as much as possible.

The above are only embodiments of the present disclosure, which are not intended to limit the protection scope of the present disclosure, any equivalent structure or process made on the basis of the description and figures the present disclosure, or a direct or indirect application in other relevant technical fields shall fall into the protection scope of the present disclosure.

What is claimed is:

1. A speaker, comprising:

a vibrating system; and a magnetic circuit system driving the vibrating system to vibrate and sound, wherein the magnetic circuit system comprises a main magnet assembly, the main magnet assembly comprises a first main magnet, a magnetic conductive piece and a second magnet which are arranged by stacking, poles of the first main magnet and the second main magnet having a same polarity are opposite to each other, wherein the magnetic conductive piece comprises a body portion clamped between the first main magnet and the second main magnet, and a clamping portion bending and extending from the body portion, the clamping portion comprises a first clamping portion for fixing the first main magnet and a second clamping portion for fixing the second main magnet.

2. The speaker as described in claim 1, wherein the first clamping portion and the second clamping portion have a same structure, both of which comprise an avoiding portion provided at a periphery of the body portion, an extending portion bended and extended from the avoiding portion in a direction perpendicular to the body portion, and a bending portion bended and extended from the extending portion in a direction towards a center of the body portion.

3. The speaker as described in claim 2, wherein the bending portion is parallel to the body portion.

4. The speaker as described in claim 2, wherein a bending portion of the first clamping portion abuts with a surface of the first main magnet departing from the body portion so as to fix the first main magnet, a bending portion of the second clamping portion abuts with a surface of the second main magnet departing from the body portion so as to fix the second main magnet.

5. The speaker as described in claim 2, wherein there is a plurality of first clamping portions, at least two first clamping portions are symmetrically provided at the body portion, there is a plurality of second clamping portions, at least two second clamping portions are symmetrically provided at the body portion.

6. The speaker as described in claim 1, wherein the first main magnet and the second main magnet are respectively provided with an avoiding portion configured to avoid the clamping portion.

7. The speaker as described in claim 1, wherein the magnetic circuit system further comprises a magnetic yoke, the main magnet assembly is assembled on the magnetic yoke, a position of the magnetic yoke corresponding to the clamping portion is provided with an avoiding notch for accommodating the clamping portion.

8. The speaker as described in claim 1, wherein the first main magnet is connected with the magnetic conductive piece through gluing, the second main magnet is connected with the magnetic conductive piece through gluing.

9. The speaker as described in claim 1, wherein the magnetic conductive piece is a soft magnet.

* * * * *